US006481404B1

(12) United States Patent
Perry et al.

(10) Patent No.: US 6,481,404 B1
(45) Date of Patent: Nov. 19, 2002

(54) VEHICLE STARTING METHOD AND SYSTEM

(75) Inventors: Brian James Perry, Canton, MI (US); Chung-Hao Shue, Belleville, MI (US); Michael Cutaiar, Dearborn, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 36 days.

(21) Appl. No.: 09/681,825

(22) Filed: Jun. 12, 2001

(51) Int. Cl.[7] ..... F02N 17/00
(52) U.S. Cl. ..... 123/179.3; 307/10.3
(58) Field of Search ..... 123/179.3, 179.9; 290/38 R; 307/10.3–10.5; 701/113

(56) References Cited

U.S. PATENT DOCUMENTS 3,629,598 A 12/1971 Rachel
3,885,543 A 5/1975 Swartz
4,590,385 A * 5/1986 Hamano et al. ..... 290/38 E
5,345,901 A * 9/1994 Siegenthaler et al. .... 123/179.3
5,742,137 A 4/1998 Bratton et al.
5,936,316 A 8/1999 Jurkiewicz et al.
6,148,781 A * 11/2000 Boegner et al. ..... 123/179.3
2002/0112689 A1 * 8/2002 Nagae et al. ..... 123/179.3

* cited by examiner

*Primary Examiner*—Thomas N. Moulis
(74) *Attorney, Agent, or Firm*—Carlos L. Hanze

(57) ABSTRACT

A method for starting a motor vehicle having an internal combustion engine, an operator actuatable switch, an electric starter and a corresponding starter relay includes coupling a first control circuit to the starter relay during one or more crank operations, and coupling a second control circuit to the starter relay during the one or more crank operations, the coupling steps resulting in a minimal delay time associated with the starting of the motor vehicle.

18 Claims, 4 Drawing Sheets

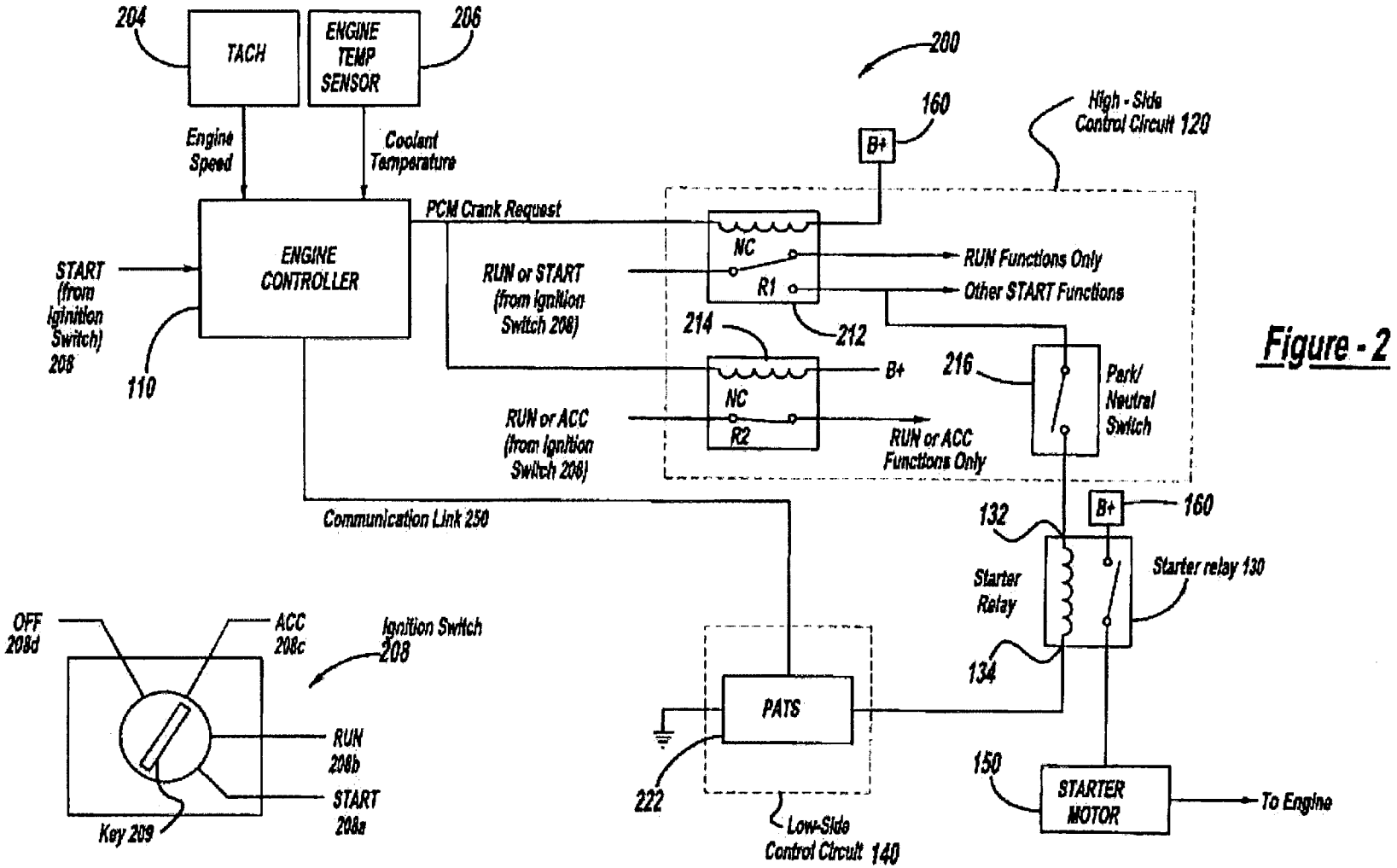
Figure - 2
High - Side Control Circuit 120
200
160
B+
RUN Functions Only
Other START Functions
Park/ Neutral Switch
216
212
214
NC
R1
R2
B+
RUN or ACC Functions Only
160
Starter relay 130
132
Starter Relay
134
STARTER MOTOR
150
To Engine
PATS
Low-Side Control Circuit 140
222
206
ENGINE TEMP SENSOR
Coolant Temperature
PCM Crank Request
RUN or START (from Ignition Switch 208)
RUN or ACC (from Ignition Switch 208)
Communication Link 250
ENGINE CONTROLLER
110
TACH
Engine Speed
204
START (from Ignition Switch) 208
Ignition Switch 208
ACC 208c
RUN 208b
START 208a
Key 209
OFF 208d

VEHICLE STARTING METHOD AND SYSTEM

BACKGROUND OF INVENTION

The present invention relates generally to a method and system for operating a motor vehicle. More particularly, the invention relates to a controller-assisted method and system for starting a motor vehicle.

Conventional motor vehicle starting systems include so-called "four-position" ignition key switches having one or more OFF or "lock" positions, an ACC ("accessories") position, a RUN position, and a START position. With the exception of alarm systems, clocks and mobile phones, most onboard electrical systems and components are typically disabled when the ignition switch is in the OFF position. When in the ACC position, designated vehicle accessories, such as a radio, power windows and the like, are activated via the vehicle's electrical system. When in the RUN position, typically all onboard electrical systems, including the vehicle's powertrain control module, are activated.

Typically, in order to start or "crank" the engine, a conventional ignition switch must be turned to the START position and held there until the engine is successfully started. However, if the key is not held in the START position for a long enough period of time, a spring mechanism provided inside the switch will force the key back to the RUN position thus removing power from the starter solenoid and disengaging the starter motor. Uneventful cranking often depends on an operator's ability to properly turn and maintain the switch in the START position for a required period of time.

Early release of the ignition switch from the START position can result in undesirable operating states of the internal combustion engine, including for example misstarts and reverse running of the engine. Repeated misstarts for example may damage the vehicle starter and reduce its longevity, and also effect a customer's satisfaction with the vehicle. Misstarts may also increase vehicle exhaust emissions during vehicle cold start conditions. To address such problems, three-position mechanical ignition switches have been developed to reduce the level of effort required by an operator to turn and maintain the ignition switch in the proper position. See for example U.S. Pat. No. 5,936,316 having a combined RUN/START and no integral return spring.

Conventional starting systems however are also characterized by crank delays inherent in the vehicle start-up process itself. These delays are especially noticeable in vehicles having passive anti-theft systems (PATS) wherein a certain amount of time is required for key verification. Depending on the algorithms used and the number of previously unsuccessful verification attempts, the overall vehicle crank delay time is increased. Add to this the time required for other start-up processes, such as fuel pump priming, and the overall crank delay time is further increased.

Accordingly, the inventors have recognized a need for an improved vehicle starting system that minimizes overall vehicle crank times and provides an improved "touch" feel to the vehicle starting process.

SUMMARY OF INVENTION

The aforedescribed limitations of conventional automobile starting systems are substantially overcome by the present invention, in which a method is provided for crank-starting a motor vehicle having an internal combustion engine, an operator actuatable switch, an electric starter and a corresponding starter relay. The method includes the steps of coupling the starter relay to a first circuit during one or more crank operations and coupling the starter relay to a second circuit during the one or more crank operations. Preferably, the first circuit is coupled to the high-side of the starter relay and the second circuit is coupled to the low-side of the starter relay. Crank operations include for example fuel pump priming and vehicle key verification.

An advantage of the present invention is that the overall crank delay of a vehicle's starting system can be minimized by providing both high-side and low-side control of the starter relay. For example, vehicle key verification can be performed simultaneously with other vehicle start-up functions such as fuel pump priming. The dual control strategy also serves to eliminate single point failures that may lead to inadvertent start-up of the vehicle.

The claimed invention has an additional advantage of improving the "feel" of the engine start-up process by providing a "touch" quality or sensitivity to a conventional vehicle ignition switch. This is realized both by a shorter crank delay time, and by controller logic that automatically triggers control of the crank process when the ignition switch is in the "start" position. In accordance with the present invention, the electronic controller assumes control of the start-up functions even when the operator misstarts the vehicle by prematurely and unintentionally releasing the ignition switch. The operator however is still able to override the starting process by turning the ignition switch to the OFF or ACC positions. The present invention thus has the further advantage of improving customer satisfaction by minimizing misstart occurrences due to premature and unintentional disengagement of the ignition switch from the "start" position.

Still further, by minimizing misstart occurrences, cold start emissions caused by manifold fuel loading are reduced. Also, by preventing re-engagement and over-engagement of the starter motor in accordance with the present invention, starter motor and flywheel longevity can be increased.

In a related aspect of the invention, a vehicle starting system is provided having a starter motor coupled to a battery via a starter relay and an operator actuatable ignition switch. The system includes a first control circuit coupled to a high-side of the starter relay, a second control circuit coupled to a low-side of the starter relay, and an electronic controller coupled to the first and second circuits for providing high-side and low-side control signals, respectively, to the first and second control circuits when the ignition switch is turned to the start position.

Further advantages, objects and features of the present invention will become apparent from the following detailed description of the invention taken in conjunction with the accompanying figures showing illustrative embodiments of the invention.

BRIEF DESCRIPTION OF DRAWINGS

For a complete understanding of the present invention and the advantages thereof, reference is now made to the following description taken in conjunction with the accompanying drawings in which like reference numerals indicate like features and wherein:

FIG. 2 is a detailed schematic diagram of a vehicle starting system in accordance with the preferred embodiment of FIG. 1;

DETAILED DESCRIPTION

Figure 1:
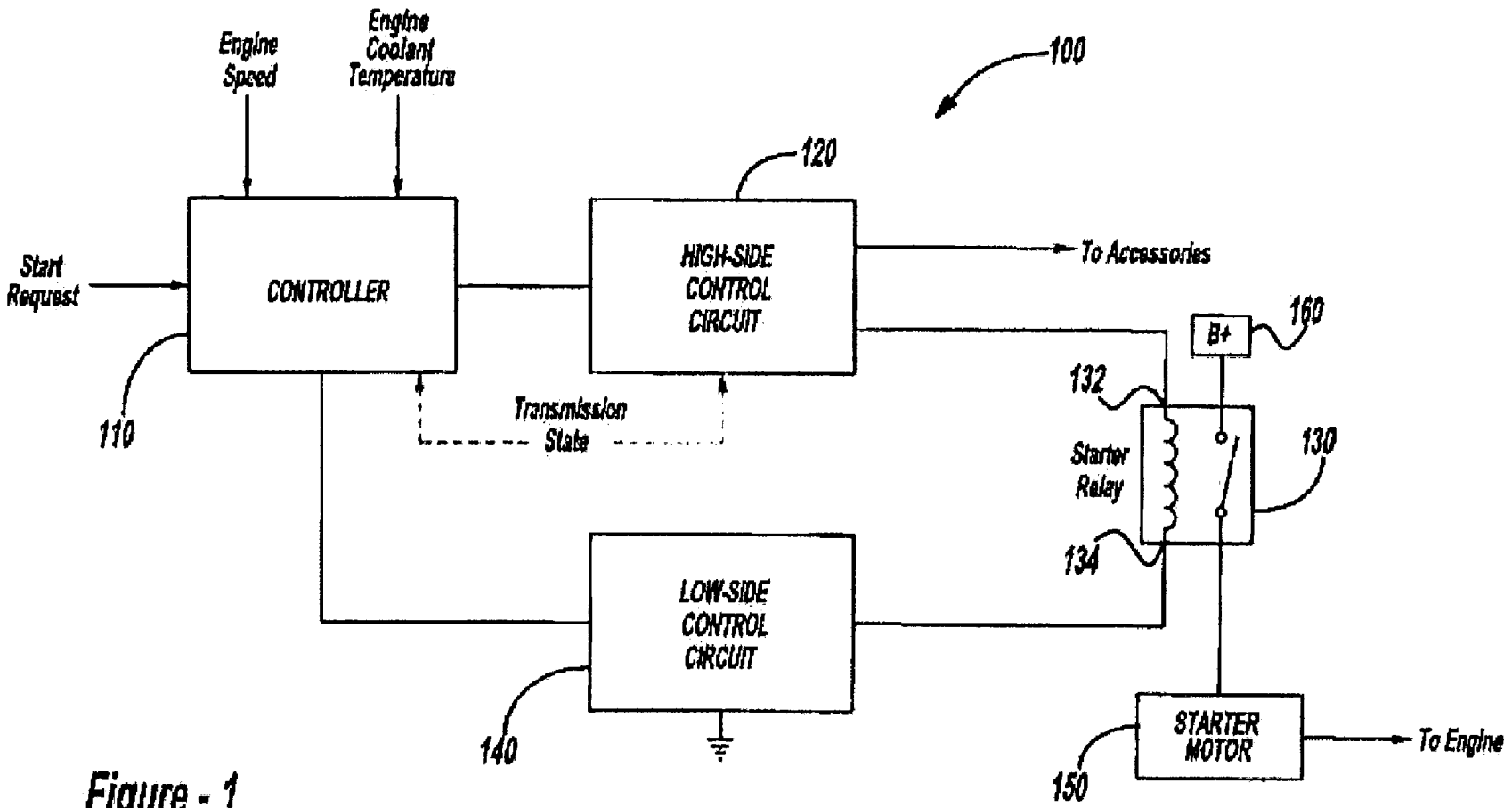
FIG. 1 is a block diagram of a vehicle starting system in accordance with a preferred embodiment of the present invention.

FIG. 1 shows a block diagram of a vehicle starting system 100 in accordance with a preferred embodiment of the present invention. As shown in FIG. 1, the system includes a starter motor 150 coupled to a battery or equivalent storage device 160 via a starter relay 130. The starter relay 130 includes a "high-side 132" at a first potential, and a "low-side" 134 at a second potential. Preferably, the "high-side" 132 of the relay is at a higher potential than the "low-side" 134 of the relay, but the invention is not so limited. When engaged via an operator actuatable switch, shown for example as 208 in FIG. 2, the starter relay is activated and electrical power is provided from the battery 160 to various vehicle components, including the starter motor 150, for vehicle start-up. As known in the art, the operator actuatable switch is preferably a four-position ignition key switch having at least one OFF or lock position, an ACC position, a RUN position and a START position.

Referring again to FIG. 1, an electronic controller 110 is provided for implementing the vehicle start-up methods of FIGS. 3 and 4 discussed below. The controller 110, which can be any suitable powertrain controller or suitable powertrain controller or microprocessor-based module, provides both a high-side control signal to a high-side control circuit 120 and a low-side control signal to a low-side control circuit 140 when the controller senses the ignition switch in the START position. Nominally, the controller 110 includes a central processing unit (CPU), a data bus of any suitable configuration, corresponding input/output ports, random-access memory (RAM), keep-alive memory (KAM) and read-only memory (ROM) or equivalent electronic storage medium 146 containing processor-executable instructions and database values for controlling engine operation in accordance with FIGS. 3 and 4. The controller 110 receives various signals from conventional vehicle sensors, the sensors including but not being limited to an engine speed sensor and an engine temperature sensor. The speed and temperature sensors are shown by way of example as sensors 204 and 206, respectively, in FIG. 2.

FIG. 2 shows a detailed schematic diagram of a vehicle starting system in accordance with the preferred embodiment of FIG. 1. The system includes a high-side control circuit 120 and a low-side control circuit 140. The high-side control circuit 120 includes a first high-side relay 212 activatable via a high-side control signal ("Crank Request") for providing electrical power to the high-side of a starter relay 130. The crank request provides a ground for the first and second high-side relays 212 and 214. Thus, when commanded, the relay 214 switches from a normally closed (NC) position to a closed R1 position and electrical power is provided for "START" and related functions. Relay 214, which is normally closed in the R2 position, is commanded via a crank request signal to disable vehicle ACC and RUN functions and enable vehicle START and related functions. Absent the crank request signal, the first high-side relay 212 is configured to enable RUN or START functions depending on the position of the ignition switch, and the second high-side relay configured to enable RUN or ACC functions.

The relay devices shown in FIG. 2, for example relays 212, 214 and 130, can be any suitable switching devices such as electromechanically-actuated or transistor-based switches. The relays can be embodied in hardware, software or a combination of both. The system of FIG. 2 further includes a transmission status switch 216, which for example can be a conventional park/neutral (PRNDL) switch, which if appropriately set in a PARK or a NEUTRAL position allows the high-side 132 of the starter relay 130 to be energized. Switch 216 also can be embodied in hardware and/or software and coupled to the electronic controller 110.

Regarding the low-side control of the starter relay 130, when a key 209 is inserted in the ignition switch 208, the controller 110 provides a key verification signal to a passive anti-theft system (PATS) module 222 via a communications link 250. The PATS module 222 can be part of the electronic controller 110, or separate as shown in FIG. 2. Preferably, the communications link 250 allows the forwarding of data messages to and from the PATS module 222.

If the PATS signal is accepted, the PATS module 222 will ground the low side of the starter. When the key is turned from the RUN to the START (crank) position, the controller checks the engine speed (RPM) and engine/coolant temperature. If RPM is below a threshold level, the controller provides a ground for the low side of a series of relays, which in turn removes current from systems that are not necessary during the crank process. If the vehicle is in PARK or NEUTRAL, current is then supplied to the high side of the starter relay thus engaging the starter.

Figure 3:
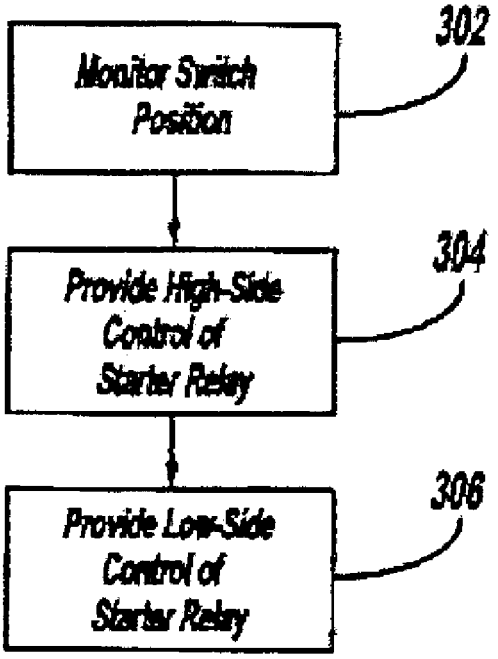
FIG. 3 is a flow diagram of a preferred method for starting a motor vehicle in accordance with the present invention.

FIG. 3 shows a flow diagram of a preferred method for starting a motor vehicle in accordance with the present invention. The method, which is implemented for example by the foregoing systems of FIGS. 1 and 2, first includes the step of monitoring a vehicle ignition switch and determining whether it is in the START position, step 302. If the ignition switch is in the START position, the high-side and low-side controls are provided to the starter relay in accordance with steps 304 and 306. Otherwise, if the ignition switch is not in the START position, then non-start operations are initiated and electrical power is supplied to various vehicle components in accordance with predefined ACC and RUN functions.

Figure 4:
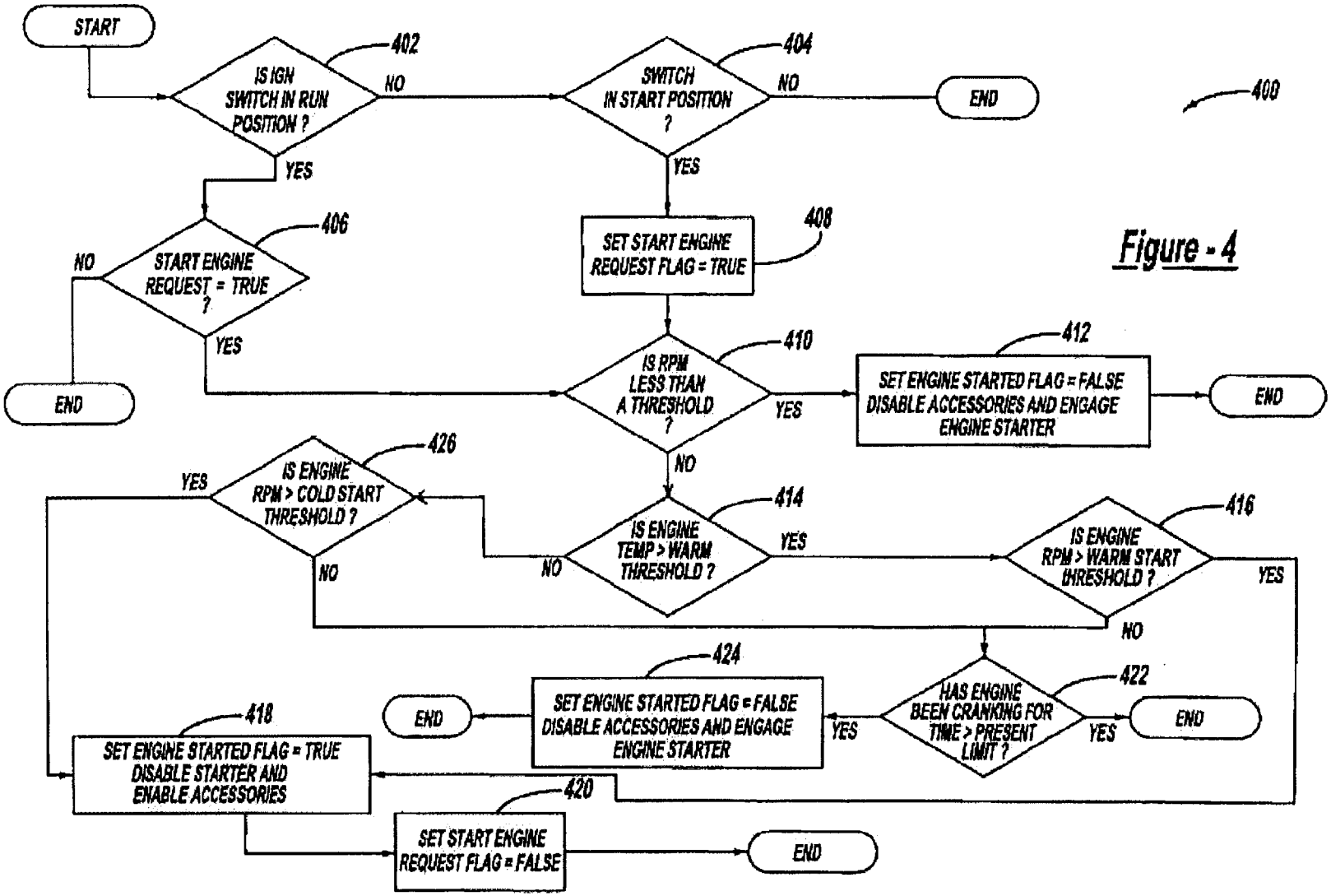
FIG. 4 is a detailed flow diagram of the vehicle starting method of FIG. 3.

FIG. 4 shows a detailed flow diagram of the preferred method of FIG. 3. The method includes the additional steps of engaging or disengaging the starter motor based on engine/coolant temperature. As shown with reference to FIG. 2, the controller 110 checks the position of the ignition switch to determine whether the switch is in either the RUN or START positions, steps 402 and 404. If the switch is in either of these two positions, then the start control method is terminated. Likewise, if the ignition switch is in the RUN position and a crank request has not yet been received ("Start Engine Request=False"), step 406, then starter control method is terminated.

Otherwise, if the ignition switch is in the START position, step 404, or if the ignition switch is in the RUN position and a crank request has already been received ("Start Engine Request=True"), steps 402 and 406, then the controller 110 checks the sensed engine speed (RPM) provided by sensor 204, step 410. The controller interrogates the engine RPM and coolant temperature to determine if a sufficient RPM has been achieved in order to disengage the starter. Once such a condition has been achieved, the controller removes the ground from the control relays 212 and 214 thus shutting off the starter and current to related electrical components/ functions. The controller then sends a Controller Area Network (CAN) message, or other suitable message, to the PATS module to remove the ground from the starter relay. If the controller determines that the RPM is not zero or greater than a given engine speed threshold (step 410), i.e., engine is running, then the crank request is ignored subject to steps 414, 416 and 426 discussed below. The engine speed threshold in accordance with step 410 is nominally set to zero.

If RPM is zero or alternatively below a predetermined speed threshold value in accordance with step 410, then the controller sets an "Engine Started Flag" to "False", disables vehicle ACC functions, and allows high-side and low-side control signals to be applied to the starter relay as described above, step 412. If however RPM is not zero (or is greater than the engine speed threshold), then the controller compares a sensed engine coolant temperature provided by sensor 206 to a predetermined "warm" engine temperature limit, step 414. The warm engine temperature limit is calibratable and can be dependent on several factors, including but not limited to the design, specific application and operating conditions of the internal combustion engine. If the engine/coolant temperature exceeds the warm temperature limit, then RPM is compared to a "warm start" RPM limit, step 416, and then in accordance with step 418, the "Engine Started Flag" is set to "True", the starter disabled and ACC functions enabled. The warm start RPM limit is also calibratable and can be dependent on several factors, including but not limited to the design, specific application and operating conditions of the internal combustion engine. A "Start Engine Request" flag is then set to "False" in accordance with step 420 to cancel any previous crank request.

If RPM is less than or equal to the warm start RPM limit in accordance with step 416, then the controller compares the amount of time the "Start Engine Request" has been set to "True" to a predetermined crank time limit, step 424. The crank time limit is calibratable and can depend on the design, specific application and operating conditions of the internal combustion engine. If the engine has been cranking for period of time less than or equal to the crank time limit, then the "Start Engine Request" flag is set to "False" and starter motor is engaged and ACC functions disabled, step 424. If however the engine crank exceeds the crank time limit, then the crank operation is terminated.

Referring again to step 414, if however the engine/coolant temperature is less than the warm temperature limit, then RPM is first compared to a "cold start" RPM limit. The cold start RPM limit is calibratable and can depend on the design, specific application and operating conditions of the internal combustion engine. If RPM exceeds the cold start RPM limit, then in accordance with steps 418 and 420 the "Engine Started Flag" is set to "True", the starter disabled, "ACC" functions enabled and the "Start Engine Request" flag set to "False". Otherwise, if RPM is less than or equal to the cold start RPM limit, then a comparison of the elapsed engine crank time and the crank time limit is performed in accordance with step 422 described above.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A method for starting a motor vehicle having an internal combustion engine, an operator actuatable switch, an electric starter and a corresponding starter relay, comprising:

coupling a first control circuit to the starter relay during one or more crank operations; and coupling a second control circuit to the starter relay during the one or more crank operations, said coupling steps resulting in a minimal delay time associated with starting of the motor vehicle.

2. The method according to claim 1, wherein the crank operations comprise priming a fuel pump coupled to the internal combustion engine.

3. The method according to claim 1, wherein the crank operations comprise verifying the presence of a programmed security code.

4. A method for starting a motor vehicle having a starter motor coupled to a battery via a starter relay, the starter relay being activatable via an ignition switch to provide electrical power from the battery to vehicle components, comprising:

providing a first signal associated with the high-side control of the starter relay; and providing a second signal associated with the low-side control of the starter relay, the first and second signals being operative to activate the starter relay when the ignition switch is configured to a start position.

5. A method for starting a motor vehicle having a starter motor coupled to a battery via a starter relay, the starter relay being activatable via an operator actuatable switch to provide electrical power from the battery to the vehicle, comprising:

monitoring the position of the operator actuatable switch;

monitoring an engine speed;

comparing the engine speed to a predetermined engine speed limit; and, if the engine speed is less than the predetermined engine speed limit, providing a first control signal associated with the high-side control of the starter relay; and providing a second control signal associated with the low-side control of the starter relay, the first and second control signals being operative to activate the starter relay when the operator actuatable switch is configured to a start position.

6. The method according to claim 5, comprising the step of disengaging the starter motor if the engine speed is below the predetermined limit.

7. A method for starting a motor vehicle having an internal combustion engine, a starter motor coupled to the engine and a battery via a starter relay, the starter relay being activatable via an operator actuatable ignition switch to provide electrical power from the battery to the vehicle, the method comprising:

monitoring the position of the ignition switch;

monitoring an engine speed;

monitoring an engine temperature;

monitoring an engine crank time; and, based at least in part on the ignition switch position, engine speed, engine temperature and engine crank time, providing a first control signal associated with the high-side control of the starter relay; and providing a second control signal associated with the low-side control of the starter relay, the first and second control signals being operative to activate the starter relay when the ignition switch is configured to a start position.

8. The method according to claim 7, further comprising the step of providing the first and second control signals if the engine speed is equal to zero.

9. The method according to claim 7, further comprising:

comparing the engine speed to a first engine speed limit;

comparing the engine temperature to at least one engine temperature limit;

comparing the engine speed to at least a second engine speed limit, the second engine speed limit being dependent on the engine temperature;

comparing the engine crank time to a engine crank time limit; and providing the first and second control signals if the engine crank time is less than or equal to the engine crank time limit.

10. The method according to claim 7, wherein if the engine speed is not equal to zero, the method further comprises the steps of:

comparing the engine temperature to a warm temperature limit;

comparing the engine speed to a warm start engine speed limit if the engine temperature is greater than the warm temperature limit; and, if the engine speed is greater than the warm start engine speed limit, providing the first and second control signals if the engine crank start time exceeds and engine crank time limit.

11. A starter control system for a motor vehicle having a starter motor coupled to a battery via a starter relay, the starter relay being activatable via an operator actuatable switch to provide electrical power from the battery to vehicle components, the system comprising:

a first control circuit coupled to a high-side of the starter relay;

a second control circuit coupled to a low-side of the starter relay; and a controller coupled to the first and second control circuits for providing high-side and low-side control signals, respectively, to said first and second control circuits when the operator actuatable switch is configured to a start position.

12. The system according to claim 11, wherein said first control circuit comprises at least one switching device activatable via the control signal.

13. The system according to claim 12, wherein said first control circuit comprises:

a first high-side relay activatable via the control signal for providing electrical power to the high-side of the starter relay; and a second high-side relay activatable via said control signal for disabling vehicle accessories while power is provided to the high-side of the starter relay.

14. The system according to claim 11, further comprising a transmission status switch for further providing high-side control of the starter relay.

15. The system according to claim 14, wherein said status switch is coupled between a first high-side switching device and the starter relay.

16. The system according to claim 14, wherein said status switch is coupled to the controller.

17. The system according to claim 11, wherein said second control circuit comprises a vehicle security system activatable via said low-side control signal.

18. An article of manufacture for a motor vehicle having a starter motor coupled to a battery via a starter relay, the starter relay being activatable via an operator actuatable switch to provide electrical power from the battery to vehicle components, the article of manufacture comprising:

a computer usable medium; and a computer readable program code embodied in the computer usable medium for directing a computer to control the steps of providing a first control signal associated with the high-side control of the starter relay, and providing a second control signal associated with the low-side control of the starter relay, the first and second control signals being operative to activate the starter relay when the ignition switch is configured to a start position.

* * * * *